US005678153A

United States Patent [19]

Okamoto et al.

[11] Patent Number: 5,678,153

[45] Date of Patent: Oct. 14, 1997

[54] FIXING APPARATUS COMPRISING A CLEANING ROLLER HAVING A COATED LAYER OF POLYIMIDE AND POLYTETRAFLUOROETHYLENE

[75] Inventors: Jun Okamoto; Setsuo Soga, both of Tokyo; Toshiya Yabei, Yokohama; Yasuhiro Kohira, Tokyo, all of Japan

[73] Assignee: Ricoh Company, Ltd., Tokyo, Japan

[21] Appl. No.: 566,153

[22] Filed: Dec. 1, 1995

[30] Foreign Application Priority Data

Dec. 1, 1994 [JP] Japan ..... 6-298562

[51] Int. Cl.[6] ..... G03G 15/20

[52] U.S. Cl. ..... 399/327; 219/216; 430/124

[58] Field of Search ..... 355/283, 290, 355/295, 297, 296; 219/216; 432/60; 118/652; 430/124, 125; 15/1.51, 256.51, 256.52; 399/327, 357

[56] References Cited

U.S. PATENT DOCUMENTS 3,861,860 1/1975 Thettu et al. ..... 355/283 X
4,530,596 7/1985 Kawamoto et al. ..... 118/652 X
4,739,370 4/1988 Yoshida et al. ..... 355/296

FOREIGN PATENT DOCUMENTS 57-53774 3/1982 Japan .
57-86873 5/1982 Japan .
60-22171 2/1985 Japan .
5-142964 6/1993 Japan .
6-342247 12/1994 Japan .
7-302012 11/1995 Japan .

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

A fixing apparatus includes a fixing roller for fixing a toner on a transferring material and a pressing roller for coming into contact with and pressing against a fixing roller. The apparatus further includes a cleaning roller which comes into contact with and cleans the fixing roller as well as a blade which scratches off toner and foreign particles transferred to the cleaning roller from the fixing roller. In the apparatus of the present invention, a coated layer including polyimide and polytetrafluorethylene is disposed on the surface of the cleaning roller.

5 Claims, 4 Drawing Sheets

FIXING APPARATUS COMPRISING A CLEANING ROLLER HAVING A COATED LAYER OF POLYIMIDE AND POLYTETRAFLUOROETHYLENE

BACKGROUND OF THE INVENTION

1. Field of the Invention

The present invention relates to a fixing apparatus used in an image forming apparatus in an electrophotographic method such as a copier, a facsimile, and a printer.

More particularly, the present invention is concerned with a fixing apparatus which has a fixing roller and a pressing roller. The fixing roller has a peeling-off layer at its peripheral surface. The pressing roller comes into contact with and presses against the fixing roller. A transferring material with non-fixed toner image is nipped and delivered with the fixing roller and the pressing roller. A non-fixed toner image on the transferring material is fixed with heat and pressure.

2. Discussion of the Background

Japanese Patent Laid-Open Publication No. 53-123147 discloses a related fixing apparatus for an image forming apparatus, in which a toner image on a transferring paper is fixed.

The fixing apparatus has a fixing roller, a pressing roller for coming into contact with and pressing against the fixing roller, a cleaning roller for cleaning the fixing roller, and a blade for scratching off toner attached to the cleaning roller.

However, the blade of the apparatus comes into contact with and presses against the cleaning roller and a surface of the cleaning roller is worn down. Therefore, the endurance of the fixing apparatus is deteriorated. High peeling-off material such as Teflon™ (Dupont product) is coated on the surface of the cleaning roller, so as to scratch off the toner attached with the cleaning roller easily. However, in this case, the surface of the cleaning roller is rapidly worn down. A cleaning roller disclosed in Japanese Laid-Open Publication No. 54-97045 is made of steel, aluminum or aluminum alloy so as to improve a cleaning performance of the cleaning roller, however, in this case the blade cannot scratch off the toner attached to the cleaning roller easily.

SUMMARY OF THE INVENTION

Accordingly, the present invention provides for a fixing apparatus for an image forming apparatus which can solve the aforementioned drawbacks, and, thus, an object of the present invention is to provide for a fixing apparatus for an image forming apparatus in which a toner or foreign particles attached to a fixing roller can be transferred to a cleaning roller securely, and the toner or foreign particles attached to the cleaning roller can be scratched off with a blade easily.

It is another object of the present invention to provide for a fixing apparatus for the image forming apparatus in which a cleaning roller cannot rapidly be worn down and an endurance and durability of the fixing apparatus can be improved.

In order to achieve the above mentioned objects, the present invention provides for a fixing apparatus which comprises a fixing roller for fixing a toner image on a transferring material, a pressing roller for coming into contact with and pressing against the fixing roller, a cleaning roller for coming into contact with and cleaning the fixing roller, and a blade for scratching off toner and foreign particles transferred to the cleaning roller from the fixing roller. In the present invention, a coated layer including polyimide and polytetrafluoroethylene is disposed on a surface of the cleaning roller.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
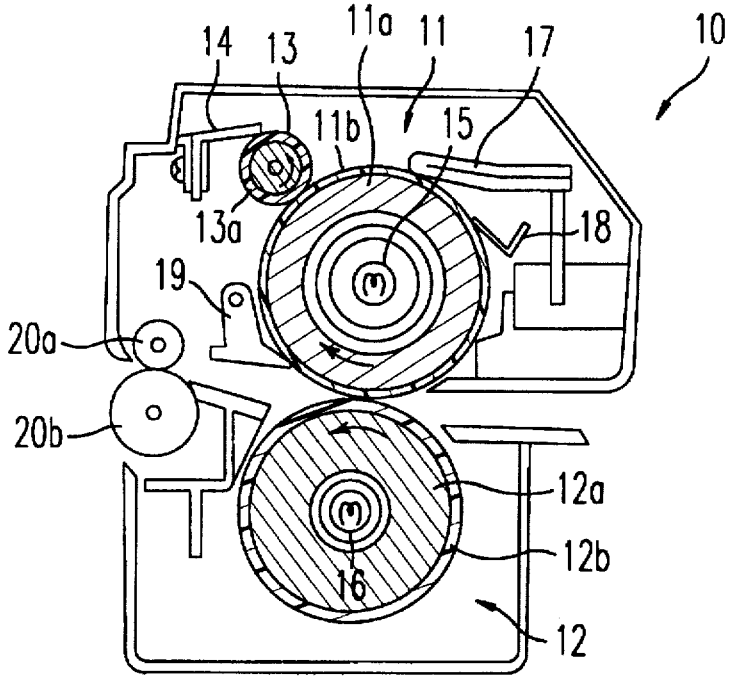
FIG. 1 is a section showing a fixing apparatus in accordance with the present invention.

Preferred embodiments of a fixing apparatus for an image forming apparatus in accordance with the present invention will now be explained with reference to the accompanying drawings, wherein like reference numerals are utilized to designate identical or corresponding elements through the several views.

FIG. 1 is a section showing a fixing apparatus in accordance with the present invention. As illustrated in FIG. 1, a fixing apparatus 10 is provided with a fixing roller 11, a pressing roller 12, a cleaning roller 13, a blade 14, a felt 17, a removing member 18, a separating claw 19, and a pair of paper discharging rollers **20*a*, 20*b***.

The fixing roller 11 accommodates a heater 15 for melting a toner on a transferring paper with heat. The pressing roller 12 which accommodates a heater 16 comes into contact with and presses against the fixing roller 11. The cleaning roller 13 comes into contact with the fixing roller 11.

The blade 14 comes into contact with the cleaning roller 13 and scratches off toner or foreign particles attached to the cleaning roller 13.

The felt 17 applies a peeling-off material to an outer surface of the fixing roller 11. The removing member 18 removes an unnecessary peeling-off material applied with the felt 17 from the fixing roller 11.

The separating claw 19 separates the transferring paper on which a toner image is fixed with the fixing roller 11 and the pressing roller 12 from the fixing roller 11.

The pair of paper discharging rollers **20*a*, 20*b* discharge the transferring paper separated with the separating claw 19**.

The fixing roller 11 has a metallic core **11*a* made of aluminum and an elastic layer 11*b* made of LTV (Low Temperature Vulcanizing) silicone rubber. An outer diameter of the fixing roller 11 is 60 mm. The thickness of the elastic layer 11*b* is 1.5 mm. A thermistor (not shown) for detecting a temperature of the fixing roller 11 is disposed on an outer surface of the fixing roller 11**. A temperature value of the thermistor is inputted into a control unit (not shown).

The control unit controls current of the heater 15 in the fixing roller 11 so as to maintain the temperature of the fixing roller 11 constant.

The pressing roller 12 has a metallic core 12*a* made of aluminum and an elastic layer 12*b* made of silicone rubber.

The cleaning roller 13 has a metallic core made of aluminum and a coated layer 13*a* including polyimide (40%~95%) and polytetrafluoroethylene (5%~30%). An outer diameter of the cleaning roller 13 can be 20 mm. A thickness of the coated layer 13*a* can be 25 μm.

The blade 14 is disposed on the surface of the cleaning roller 13, in a counter direction to a rotating direction of the cleaning roller 13, and is made of a heat resistant resin such as polyimide or metal such as stainless steel.

Figure 2:
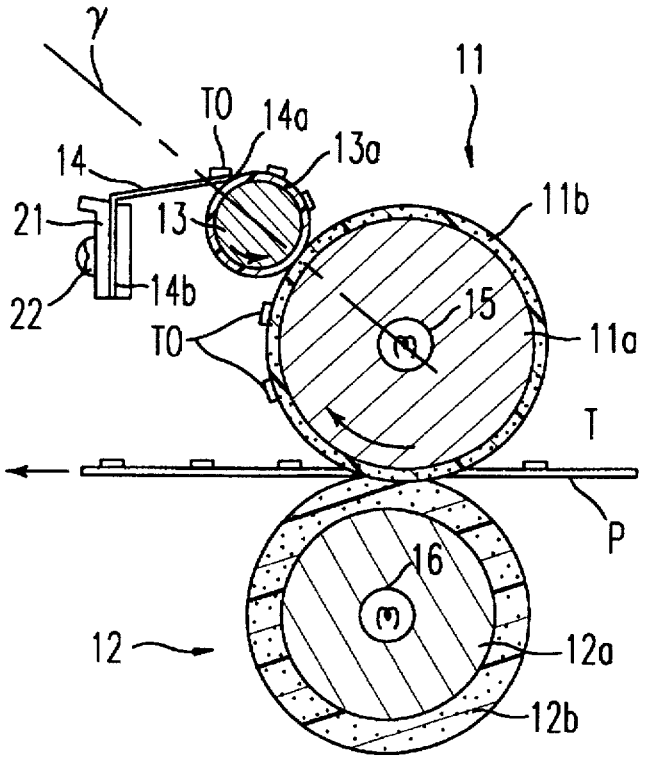
FIG. 2 is a section showing the enlarged fixing apparatus of FIG. 1.

The blade 14 is a plate spring, and is L-shaped in cross-section. The thickness of the blade 14 can be 0.2 mm. A free edge 14*a* (FIG. 2) of the blade 14 is located on an extended line γ connected between a center of the fixing roller 11 and that of the cleaning roller 13.

The blade 14 presses against the outer surface of the cleaning roller 13 by the force of 0.1 Kgf/cm. The cleaning roller 13 presses against the fixing roller 11 by the force of the blade 14.

A base portion 14*b* of the blade 14 is fixed on a fixture member 21 disposed on a housing of the fixing apparatus with screws 22.

Figure 3:
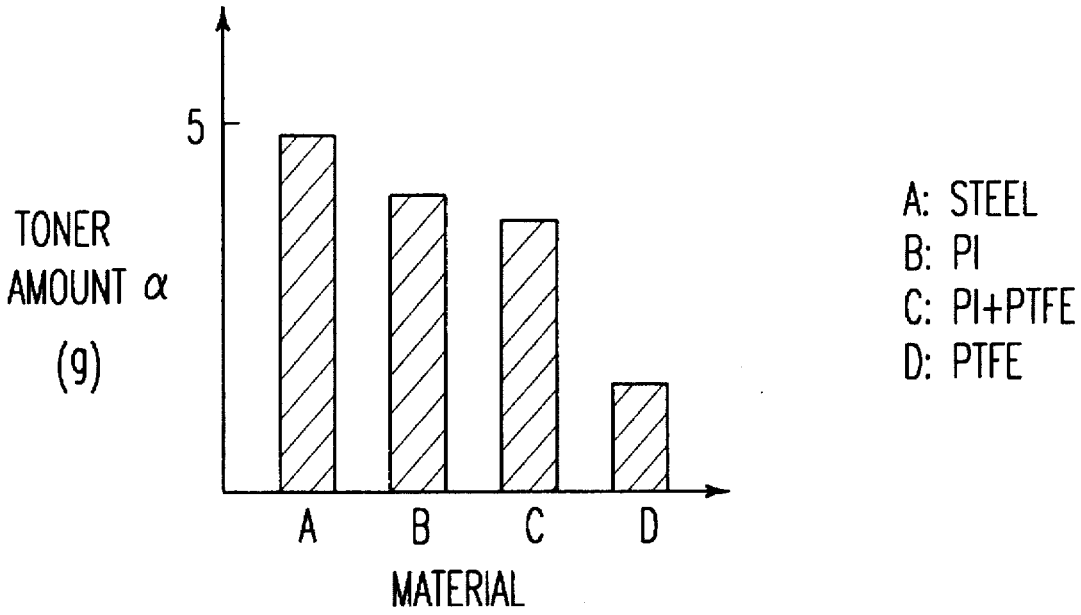
FIG. 3 is a graph explaining a relationship between a material of a coated layer on the cleaning roller and an amount of toner transferred to the cleaning roller.

Referring to FIG. 3, a experiment for measuring an amount of toner transferred to the cleaning roller 13 is performed.

The coated layer 13*a* of the cleaning roller 13 is made of stainless steel, or polyimide (P1), or polyimide (P1) and polytetrafluoroethylene (PTFE), or polytetrafluoroethylene (PTFE).

In the experiment, a color image forming apparatus is sued with a low softening point toner. The experiment operation time is 60 hours. A temperature of the fixing roller 11 is set to 180° C.~200° C. An image with a large black area is formed on the transferring paper so as to make a hot-offset, in which a part of the toner on the transferring paper is unnecessarily transferred to the fixing roller 11.

A result of the experiment is shown in FIG. 3. Four materials (A, B, C, D) of a coated layer 13*a* of the cleaning roller 13 is shown in a horizontal axis coordinate of the graph in FIG. 3.

Material A is stainless steel;

Material B is polyimide;

Material C is polyimide and polytetrafluoroethylene; and

Material D is polytetrafluoroethylene.

Amount α of the toner transferred to the cleaning roller 13 is shown in a vertical axis coordinate of the graph in FIG. 3.

Amount α in the material A, B, C, D satisfies the following condition.

$$\alpha \text{ of } A \geqq \alpha \text{ of } B \geqq \alpha \text{ of } C \geqq \alpha \text{ of } D;$$

Amount α is determined by a peeling-off character to the LTV silicone rubber of the elastic layer 11*b* in the fixing roller 11.

Figure 4:
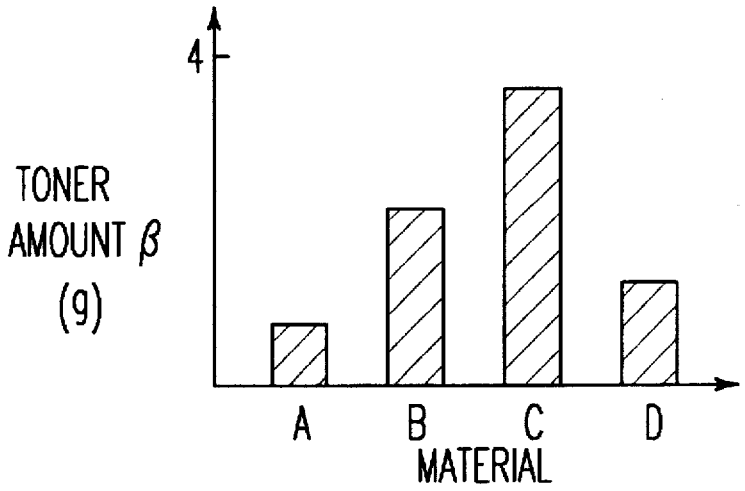
FIG. 4 is a graph explaining a relationship between a material of a coated layer on a cleaning roller and an amount of toner transferred to a blade.

Another result of the experiment is shown in FIG. 4. The amount β of a toner transferred to the blade 14 from the respective cleaning roller 13 is measured. Four materials (A, B, C, D) of the coated layer 13*a* of the cleaning roller 13 are shown in a horizontal axis coordinate of a graph in FIG. 4. The amount β is shown in a vertical axis coordinate of the graph in FIG. 4, and the amount B in the material A, B, C, D satisfies the following condition.

$$\beta \text{ of } C > \beta \text{ of } B > \beta \text{ of } D > \beta \text{ of } A$$

Referring to FIG. 3 and FIG. 4, a cleaning character which means the amount α of a toner transferred to the cleaning roller 13 from the fixing roller 11 and the amount β of a toner transferred to the blade 14 from the cleaning roller 13 is high in the material C.

The coated layer 13*a* of the cleaning roller 13 in the present invention includes polyimide and polytetrafluoroethylene.

Figure 5:
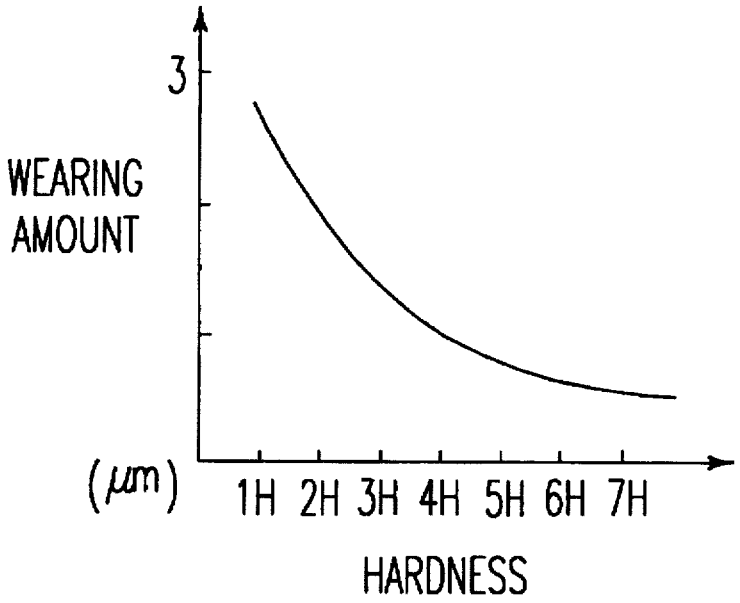
FIG. 5 is a graph explaining a relationship between the hardness of a coated layer on a cleaning roller and a wearing amount of the coated layer.

Another result of the experiment is shown in FIG. 5. The wearing amount of the coated layer 13*a* of the cleaning roller 13 by the scratching of the blade 14 is measured with varying pencil hardness (JIS G0202) of the coated layer 13*a*. Referring to FIG. 5, when the pencil hardness of the coated layer 13*a* is high, the wearing amount of the coated layer 13*a* is decreased, and an endurance of the cleaning roller 13 is improved.

A lifetime of the image forming apparatus is about 3000 hours in operation time. The cleaning roller 13 requires a high endurance character so that the cleaning roller 13 is not fractured by rotating and being scratched with the blade 14 in about 3000 hours.

When the thickness of the coated layer 13*a* is 25 μm, the pencil hardness of the coated layer 13*a* is more than 5H scale (preferably 7H scale) so as to maintain high endurance and cleaning characters of the coated layer 13*a* in about 3000 hours.

The coated layer 13*a* of the cleaning roller 13 in the present invention has a pencil hardness of 5H scale or more.

Figure 6:
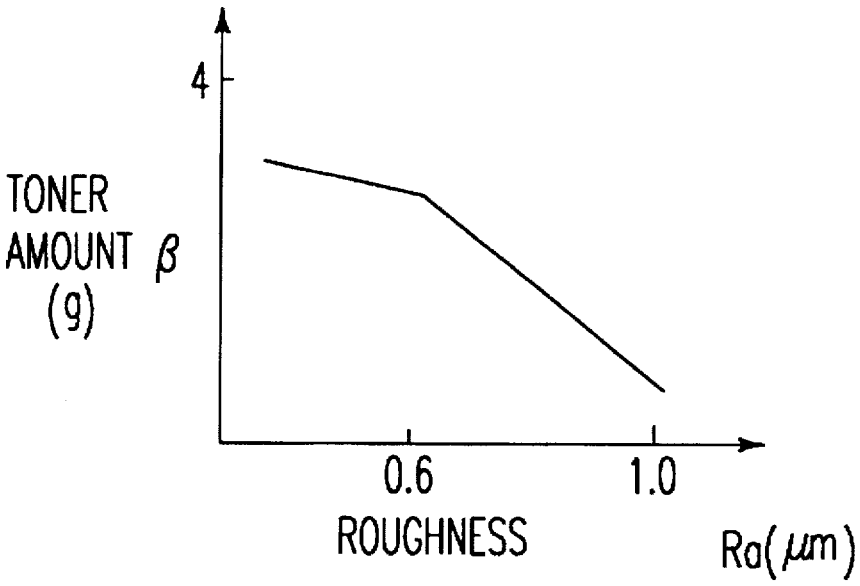
FIG. 6 is a graph explaining a relationship between the surface roughness of a coated layer on a cleaning roller and an amount of toner transferred to a blade.

Another result of the experiment is shown in FIG. 6. The amount β of a toner transferred to the blade 14 from the cleaning roller 13 is measured with varying surface roughness Ra (150 International Organization for Standardization 4287/1 Arithmetical Mean Deviation of Profile) of the coated layer 13*a* of the cleaning roller 13.

Referring to FIG. 6, when the surface roughness Ra of the coated layer 13*a* is large, the amount β of toner transferred to the blade 14 is decreased.

A clearance between the blade 14 and the coated layer 13*a* occurs such that toner on the coated layer 13*a* is inserted into the clearance and cannot be scratched off. The surface of the coated layer 13*a* is coated with the toner which cannot be scratched off.

When the surface roughness Ra of the coated layer 13*a* is more than 0.6 μm, the toner on the coated layer 13*a* cannot be scratched off.

When the surface roughness Ra of the coated layer 13*a* is more than 1.0 μm, the surface of the coated layer 13 is coated with the toner and the cleaning character of the cleaning roller is deteriorated. The coated layer 13*a* of the cleaning roller 13 in the present invention has a surface roughness Ra of 0.6 μm or less.

An operating state of the fixing apparatus for the image forming apparatus is explained hereinafter.

The transferring paper on which a toner image is transferred by a transferring apparatus (not shown) is delivered into the fixing apparatus 10.

The transferring paper is inserted between the fixing roller 11 and the pressing roller 12, which are heated to a predetermined temperature by the control unit. The toner image is fixed on the transferring paper with heat.

The transferring paper is separated from the surface of the fixing roller 11 by the claw 19, and is discharged by the pair of paper discharging rollers 20*a*, 20*b*.

When the transferring paper on which the toner image is transferred comes into contact with the fixing roller 11, a part of the toner image or foreign particles T such as paper particles are unnecessarily transferred to the fixing roller 11, which is called off-set toner $T_o$. The off-set toner $T_o$ or foreign particle on the fixing roller 11 is delivered to a contacting surface between the fixing roller 11 and the cleaning roller 13, and is transferred to the cleaning roller 13.

The off-set toner $T_o$ or foreign particles which are transferred to the cleaning roller 13 are scratched off with the blade 14.

Figure 7:
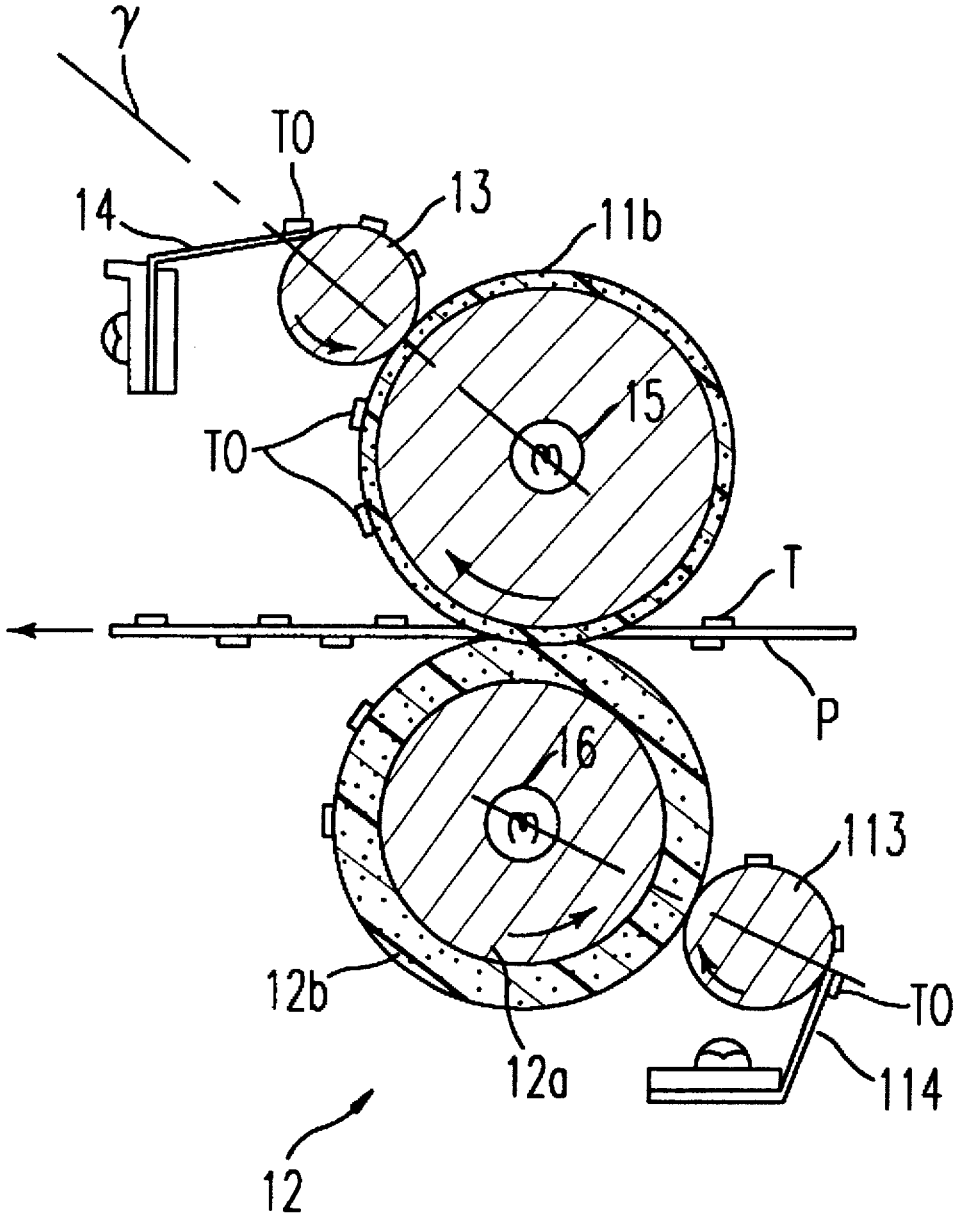
FIG. 7 is a section showing a further enlarged fixing apparatus of FIG. 1.

FIG. 7 is a section showing a further enlarged fixing apparatus of FIG. 1. The same reference numerals are used to identify the same members, and a detailed explanation thereof is omitted here. Referring to FIG. 7, when first and second toner images are fixed on a surface and back sides of the transferring paper respectively, a part of the first toner image which is firstly fixed on the back side of the transferring paper is transferred to the pressing roller 12 unnecessarily. Another cleaning roller 113 is disposed on the pressing roller 12. Another blade 114 is disposed on the cleaning roller 113 so as to scratch off the toner or foreign particle transferred to the cleaning roller 113.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A fixing apparatus comprising:

a fixing roller for fixing a toner image on a transferring material;

a pressing roller for coming into contact with and pressing against said fixing roller;

a cleaning roller for coming into contact with and cleaning said fixing roller; and a blade for scratching off toner and foreign particles transferred to said cleaning roller from said fixing roller;

wherein a coated layer including polyimide and polytetrafluorethylene is disposed on a surface of said cleaning roller.

2. A fixing apparatus according to claim 1, wherein said coated layer of said cleaning roller has a pencil hardness based on, JIS Japanese Industrial Standard, of 5H scale or more.

3. A fixing apparatus according to claim 1, wherein said coated layer of said cleaning roller has a surface roughness of 0.6 μm or less.

4. A fixing apparatus according to claim 1, wherein said cleaning roller comprises a metallic core made of aluminum.

5. A fixing apparatus according to claim 1, wherein a free edge of said blade contacts said cleaning roller on a line which extends between a center of the fixing roller and a center of the cleaning roller.

* * * * *